US009896757B2

(12) United States Patent
Cordea et al.

(10) Patent No.: US 9,896,757 B2
(45) Date of Patent: Feb. 20, 2018

(54) GALLING AND CORROSION RESISTANT INNER DIAMETER SURFACE IN ALUMINUM CASTER ROLL SHELL STEELS

(71) Applicant: SHULTZ STEEL COMPANY, South Gate, CA (US)

(72) Inventors: James N. Cordea, Largo, FL (US); Dennis M. Smith, Crestline, CA (US); Anthony Vinter, Rolling Hills, CA (US)

(73) Assignee: SHULTZ STEEL COMPANY, South Gate, CA (US)

( * ) Notice: Subject to any disclaimer, the term of this patent is extended or adjusted under 35 U.S.C. 154(b) by 256 days.

(21) Appl. No.: 14/791,150

(22) Filed: Jul. 2, 2015

(65) Prior Publication Data

US 2017/0002453 A1 Jan. 5, 2017

(51) Int. Cl.

| | |
|---|---|
| ***B22D 11/06*** | (2006.01) |
| ***C23C 8/04*** | (2006.01) |
| ***C23C 8/38*** | (2006.01) |
| ***C23C 8/02*** | (2006.01) |
| ***C23C 8/26*** | (2006.01) |
| ***C23C 8/50*** | (2006.01) |
| ***C23C 8/80*** | (2006.01) |

(52) U.S. Cl.

CPC ..... *C23C 8/04* (2013.01); *B22D 11/0651* (2013.01); *C23C 8/02* (2013.01); *C23C 8/26* (2013.01); *C23C 8/38* (2013.01); *C23C 8/50* (2013.01); *C23C 8/80* (2013.01)

(58) Field of Classification Search

CPC ..... B22D 11/06; B22D 11/0651
USPC ..... 164/427, 428, 429
See application file for complete search history.

(56) References Cited

U.S. PATENT DOCUMENTS

| | | | |
|---|---|---|---|
| 3,022,204 | A | 2/1962 | Muller et al. |
| 4,409,027 | A | 10/1983 | Cordea et al. |
| 4,710,238 | A | 12/1987 | Dawes et al. |
| 5,265,332 | A | 11/1993 | Hartz |
| 5,599,497 | A | 2/1997 | Cordea et al. |
| 6,284,062 | B1 | 9/2001 | Nagashima et al. |
| 8,105,692 | B2 | 1/2012 | Dumm et al. |

(Continued)

FOREIGN PATENT DOCUMENTS

| | | |
|---|---|---|
| CN | 1304142 C | 3/2007 |
| EP | 0304047 A1 | 2/1989 |

OTHER PUBLICATIONS

Tschiptschin, A.P.; Toro, A.—"Surface Properties of High Nitrogen Steels"—in HNS 2003—High Nitrogen Steels—ed. Marcus Speidel, Claudia Kowanda, Marcus Diener—vsg Hochschulverlag AG—Switzerland—pp. 229-240, 2003.

(Continued)

*Primary Examiner* — Kevin P Kerns
(74) *Attorney, Agent, or Firm* — Burris Law, PLLC

(57) ABSTRACT

A strip casting apparatus having a roll shell with a nitrided inner diameter surface mounted on a steel core and method of manufacturing the same. The inner diameter of a steel roll shell may be nitrided by ion or plasma nitriding. The nitriding process can form tight, crack free nitride layer that provides a corrosion resistant barrier and exhibits a surface hardness that is greater than the surface hardness of the steel core and that improves galling resistance while maintaining efficient heat transfer of the roll shell. After nitriding, the roll shell can be shrink fit over a steel core.

22 Claims, 3 Drawing Sheets
(1 of 3 Drawing Sheet(s) Filed in Color)

(56) References Cited

U.S. PATENT DOCUMENTS

| | | | |
|---|---|---|---|
| 8,303,892 | B2 | 11/2012 | Sheth et al. |
| 2005/0039875 | A1 | 2/2005 | Hohenbichler et al. |

OTHER PUBLICATIONS

Ipsen; "Heat Treatment of Stainless Steels Using the SolNit Process"; http://www.ipsenusa.com/processes-and-resources/processes/heat-treating-stainless-steels; published in 2015; 5 Pages.

Krastev (2012); "Improvement of Corrosion Resistance of Steels by Surface Modification", Corrosion Resistance, Dr. Shih (Ed.), ISBN: 978-953-51-0467-4, InTech, 23 Pages.

Nitrided Layer on HS521 Alloy

GALLING AND CORROSION RESISTANT INNER DIAMETER SURFACE IN ALUMINUM CASTER ROLL SHELL STEELS

BACKGROUND OF THE INVENTION

Field of the Invention

The present invention relates to a galling and corrosion resistant inner diameter surface in aluminum caster roll shell steels. Particularly, the invention relates to the treatment and final product of the inner diameter surface of a caster roll shell through a nitriding process.

Discussion of the Related Art

Hollow, cylindrical steel roll shells that are used in the strip casting of aluminum (Al) and other lower melting metals are shrink fitted on a cylindrical solid steel core. The core outer diameter surface can be cylindrically grooved to provide a water channel path for cooling of the roll shell. The core hardness has typically been higher than that of the roll shells. The core is typically manufactured by weld overlaying a typical AISI 4130 core with 420 SS (up to 50 to 56 HRc) which can then be machined to generate the cylindrical water channels. An exemplary roll shell-core configuration includes a roll set with two roll shells, each around a core, that act as a die that solidifies the lower temperature metal such as Al. Molten metal, e.g. Al, enters the revolving roll set on one side and emerges as a solid wide thin strip on the exit side.

Because the steel roll shell is shrink fit onto the steel core, the roll shell tends to move slowly on the core during the casting operation. It is important, therefore, that the internal diameter surface of the roll shell has sufficient galling resistance to minimize any metal debris produced by the surface-to-surface grinding movement. In current applications metal debris is generated over time and accumulates in the water channels that may be provided onto the steel core. The debris can restrict and sometimes block the cooling water flow. This can directly affect the uniform heat extraction by the roll shell-core rolls and result in wide variation in Al strip thickness. As a consequence, the further cold rolling reduction of the strip to uniform sheet becomes very difficult if not impossible to accomplish.

Many attempts to reduce galling and debris generation in the core coolant channels have been explored. The most obvious solution has been to increase the interference shrink fit between the roll shell and core so that the slippage which causes the galling and debris generation is greatly reduced. However, this causes earlier generation of outer diameter surface heat checking or cracking as a result of the exceedingly higher circumferential tension stresses. Thus, interference shrink fit can often lead to a reduced service life of the roll set and can also result in early catastrophic failure.

One example of mechanically enhancing the interference shrink fit is disclosed in U.S. Patent Application Publication No. 2005/039875, which is incorporated herein by reference. In this application, a steel core and a copper roll shell are provided with protuberances and indentations oriented at least partially in the direction of the casting roll axis and extending radially for at least 2 μm. Although this process may lead to reduced galling, the rough mechanical bonded surfaces of the core and roll shell can potentially reduce the rate of heat transfer and thus not necessarily improve the overall casting process.

Increasing the hardness of the overall steel roll shell by going to higher carbon steel alloys and alloying to produce high temperature yield strength has been used to develop a greater resistance to heat checking. An example of such approach is provided in U.S. Pat. No. 4,409,027, which is incorporated herein by reference. The higher hardness associated with these higher strength roll shells (46 to 48 HRc) is somewhat resistant to galling damage at the roll shell-core interface. However, the results are not ideal and the increased brittleness associated with higher strength alloys results in less shrink fit, which has been known to increase movement at the roll shell-core interface and thus potentially increase the generation of debris. Another disadvantage of using increased hardness roll shell is that it requires more care in handling the roll shells during installation and intermediate surface conditioning to avoid cracking and breakage.

Selected alloy content increases in lower carbon steel roll shells, as exemplified in U.S. Pat. No. 5,599,497, which is incorporated herein by reference, has been very effective in reducing the onset of heat checking through high temperature strengthening by alloy carbide and nitride precipitation hardening that also allows for greater shrink fit to reduce roll shell-core movement. However, this approach does not address the problem of galling on the roll shell inner diameter surface because of the slightly lower hardness 44 to 46 HRc. Also, the higher alloy content can reduce the thermal conductivity in the roll shell and its ability to withdraw heat from the incoming molten Al.

Recently, in U.S. Pat. No. 8,303,892, which is incorporated herein by reference, it has been proposed that the alloy content be decreased even further to promote faster strip production rates by virtue of maximizing heat conductivity in the roll shell. However, again this has come at the cost of slightly lower roll shell hardness levels (42 to 44 HRc) and thus the potential for greater debris generation at the roll shell-core interface.

A commonly used procedure to address the above problems is to add a hard metal coating such as Cr (up to 0.004 in. thick and 58 to 62 Rc) or other hard elements to the inner diameter surface of the roll shell to increase abrasion resistance at the roll shell-core interface. This process, however, is limited to low temperature applications so as not to interfere with the mechanical properties of the roll shell. This limits the process to electrolytic plating as for example described in U.S. Pat. No. 5,265,332, which is incorporated herein by reference, that describes the procedure and its benefits. Through this coating process, abrasion galling resistance can initially be improved at the roll shell-core interface because the Cr coated steel roll shell can slide more easily over the core during casting. However, it has been shown that the brittle Cr plating often can contain numerous cracks or fissures that can break loose and cause debris buildup in the water channel. Also, the Cr plating can act as a barrier to heat extraction from the Al strip solidification thus slowing down the casting speed.

Another deleterious problem frequently experienced with Cr plating is the onset of galvanic corrosion of the roll shell under these Cr plates. This is caused by the coolant water seeping through the cracks in the Cr plate to the roll shell steel. Because of this effect, cracks can form in the roll shell inner diameter surface. The cracks often can initiate in the roll shells at the crevices where the core edges, at the water channels, meet the roll shell inner diameter surface. The corrosion rate at these crevices that become exposed to the coolant water flowing through the core channels is accelerated by the 100% Cr plated surfaces that drive the corrosion, by the area effect, to the less noble roll shell steel (usually 2% to 4% Cr in typical roll shells). When a roll shell crack is formed it can easily spread by the cyclic stresses during casting from the inner diameter surface roll shell surface outward to the roll shell outer diameter surface. This can lead to the roll shell springing water leaks or to catastrophic failure during the casting operation.

Attempts have been made to minimize the cracking by adding inhibitors to control the pH of the coolant water but have not been very effective because the inhibitors often increase the conductivity of the solution to 300-400 MMHOS/cm or higher, and thus promote galvanic corrosion especially at the core edges-roll shell inner diameter surface crevices.

Attempts have also been made to reduce the conductivity of the coolant water by using de-ionized water. However, this is a very expensive process that is nearly impossible to attain in commercial water coolant systems.

SUMMARY OF THE INVENTION

Accordingly, the present invention is directed to galling and corrosion resistant inner diameter surface in aluminum caster roll shell steels that substantially obviates one or more of the problems due to limitations and disadvantages of the related art.

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve the advantages and in accordance with the purpose of the present invention, as embodied and broadly described, it is provided a strip casting apparatus having a roll core and a roll shell having an outer diameter surface and a nitrided inner diameter surface.

In another aspect of the present invention, provided are methods of manufacturing a casting roll apparatus that includes providing a steel roll shell having an inner diameter surface, nitriding the inner diameter surface of the steel roll shell, mounting the nitrided steel roll shell on a steel roll core, and shrink fitting the nitrided steel roll shell onto the roll core.

In another aspect of the present invention, provided are methods of nitriding the inner diameter surface of a roll shell core that include providing a steel roll shell core, cleaning a surface of the steel roll shell, heating the steel roll shell to a first temperature, exposing the surface of the steel roll shell to a mixture of nitrogen and oxygen, heating the steel roll shell to a second temperature that is higher than the first temperature and applying a current to create a nitrogen plasma.

It is to be understood that both the foregoing general description and the following detailed description are exemplary and explanatory and are intended to provide further explanation of the invention as claimed.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, which are included to provide a further understanding of the invention and are incorporated in and constitute a part of this specification, illustrate embodiments of the invention and together with the description serve to explain the principles of the invention.

In the drawings:

Figure 1:
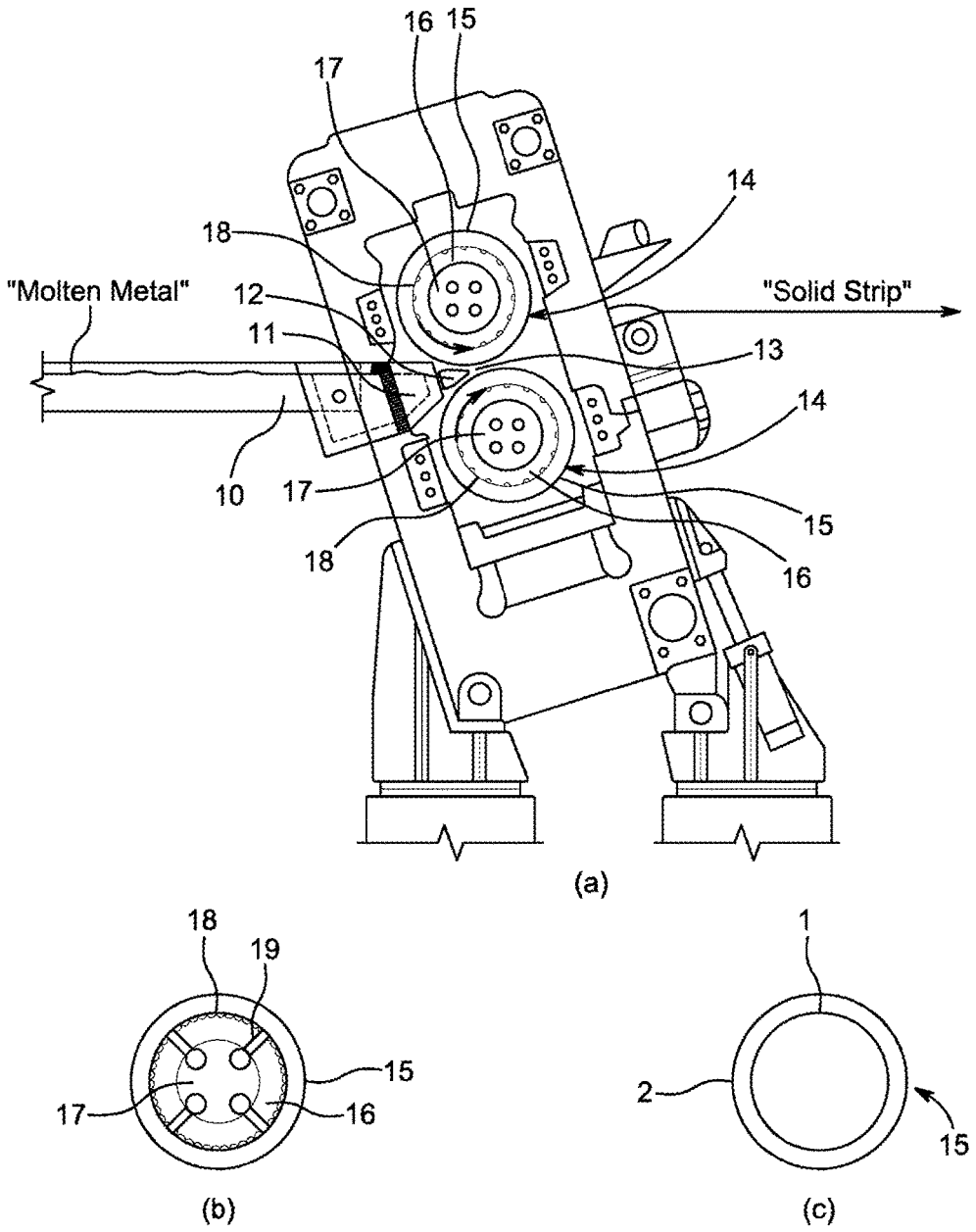

FIG. 1(*a*)-(*c*) illustrate an exemplary embodiment of a strip caster.

Figure 2:
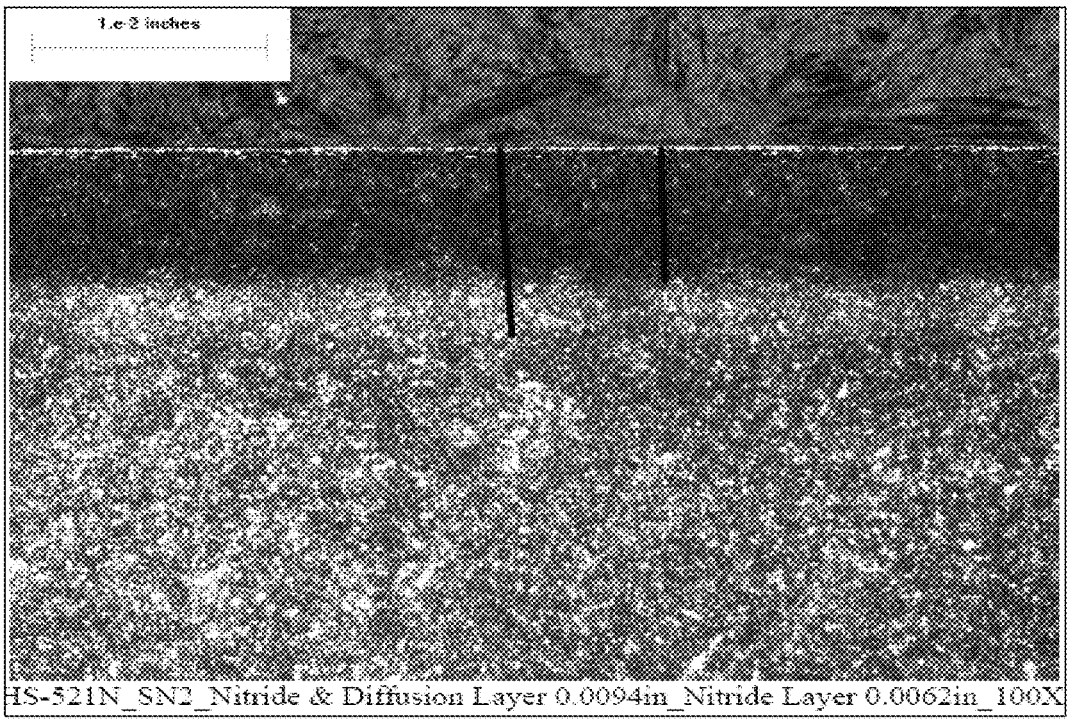

FIG. 2 is an exemplary embodiment of the present invention showing the depth of the nitrogen in a nitrided inner diameter surface of a roll shell.

Figure 3:
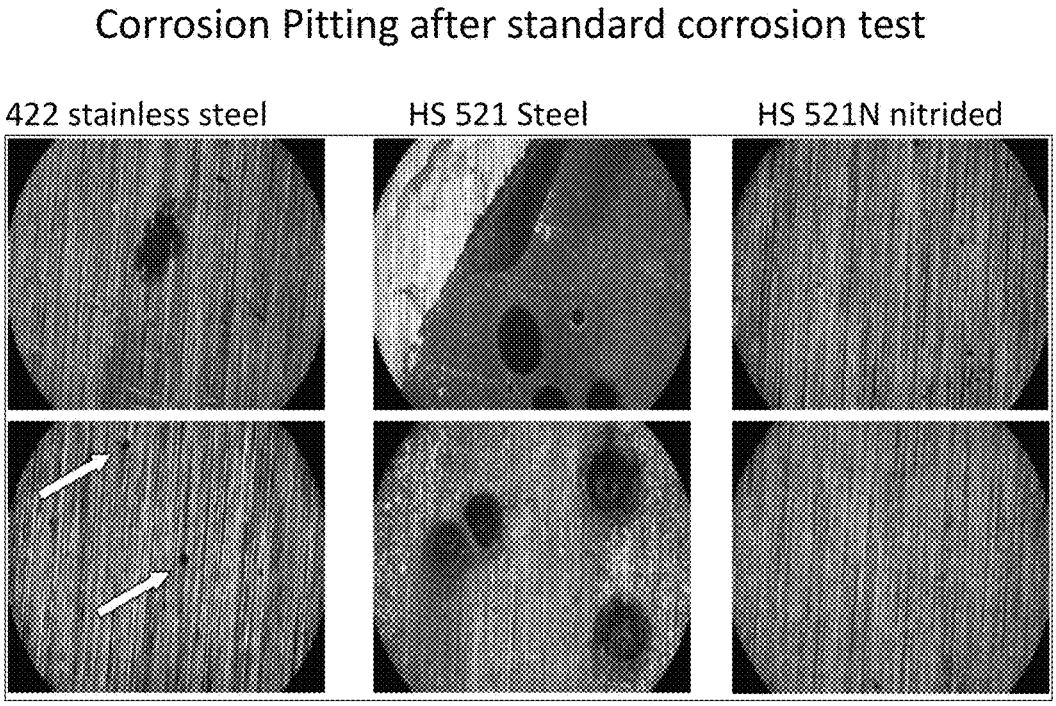

FIG. 3 provides comparative results of corrosion pitting after a standard corrosion test.

DETAILED DESCRIPTION OF THE ILLUSTRATED EMBODIMENTS

Reference will now be made in detail to an embodiment of the present invention, example of which is illustrated in the accompanying drawings.

Referring to FIG. 1(*a*)-(*c*), a representative type of strip caster for a molten material, such as molten aluminum is shown. Here, in one embodiment, molten aluminum is maintained at a constant level in a headbox positioned in such manner that the molten aluminum (or molten metal), indicated at 10, flows by gravity into a distribution box indicated at 11 in which it is directed upwardly through a feed nozzle assembly 12 into a freezing zone 13. A pair of water-cooled rolls, indicated generally at 14, is provided which are driven in counter-rotating directions as shown by arrows in FIG. 1(*a*)-(*c*). The bite of the rolls is slightly above the freezing zone 13, so that the molten aluminum solidifies just before reaching the bite of the rolls and is hot rolled as it passes there between.

Each caster roll 14 is composed of a roll shell 15 which is a forged, heat treated hollow cylinder. By its nature the hollow cylinder includes an inner diameter surface, item 1 and an outer diameter surface item 2. A core 16, with water channels machined into its surface, is provided on which the outer roll shell 15 is mounted by a shrink fit, i.e., the roll shell is heated, causing it to expand, and is slipped over the core. The roll shell then shrinks upon cooling to fit tightly around the core. A water rotating joint assembly 17 is provided with cooling water inlet and outlet holes that connect to channels 18 via the radial tubes 19, providing cooling water outwardly to the inner diameter surface of the roll shell 15.

In exemplary embodiments of the present invention, galling can be prevented and corrosion resistance can be improved by nitriding the inner diameter surface of the steel roll shell of a strip casting apparatus.

As used herein, the term "surface" should be understood to refer to the exposed area of an object. The term "inner diameter surface" as used in reference to the roll shell or steel roll shell, refers to the area of inner diameter surface of a roll shell that is typically exposed prior to installing the roll shell onto the core. The inner diameter surface of the roll shell or steel roll shell is identified as item 1 in FIG. 1(*c*). In preferred embodiments, the inner diameter surface is the surface of the roll shell that will contact the core. The term "outer diameter surface" as used in reference to the roll shell or steel roll shell refers to the exposed area identified as item 2 in FIG. 1(*c*). The term "outer diameter surface" as used in reference to the core, steel core, or roll core refers to the exposed area of the core that is in contact with the inner surface of the roll shell. The term "surface layer" is used herein to refer to a thickness that extends from the surface to a measurable depth. In exemplary embodiments, a "surface layer" can extend between 0.004 inch and 0.008 inch deep from the surface.

In preferred embodiments the nitriding is achieved by ion nitriding, a process that produces a hard, dense, crack-free, inner diameter surface layer. However, other nitriding processes such as gas or liquid nitriding can also be used. In exemplary embodiments the nitriding is carried out over the entire inner diameter surface of the roll shell. In alternative embodiments, the nitriding is carried out only in the portions of the inner diameter surface of the roll shell that contact the core. In yet other exemplary embodiments, the nitriding is carried out only in some portion of the inner diameter surface of the roll shell that contact the core.

The nitriding process may be carried out on the inner diameter surface of the roll shell or alternatively all over the roll shell. In exemplary embodiments, only the inner diameter surface of the roll shell is nitrided. In such embodiments, the outer diameter surface of the roll shell is not nitrided. In alternative embodiments, the inner diameter surface and the outer diameter surface of the roll shell are nitrided.

In exemplary embodiments, the nitriding step is carried out via ion nitriding or sometimes termed plasma nitriding. Ion nitriding is preferable because it can result in a tighter molecular bond and a more uniform hard case when compared to the minimally bonded Cr plating that contains many fissures and tends to disintegrate during the movement of the roll shell over the core. Ion nitriding can be conducted in a chamber filled with nitrogen gas. The shell can be made the cathode and an applied voltage can be used to ionize the nitrogen gas causing the positively charged nitrogen ions to energetically bombard the surface of the roll shell inner diameter, thereby penetrate and diffuse into the roll shell steel to form a surface layer of metallic nitrides and resulting in a very hard case. The nitrided steel case is very uniform and can contain no cracks. The nitriding process can be carried out very rapidly compared to conventional gas or liquid salt bath processes.

In an exemplary embodiment, the surface of the roll shell to be treated is first cleaned with a solvent, such as acetone and then wiped down. In exemplary embodiments, cleaning of the roll shell surface prior to ion nitriding can be performed to achieve a surface that is free of dirt and/or oil. In exemplary embodiments, the surface treated by ion nitriding is also cleaned by the ion bombardment that occurs during the ion nitriding process. The part is then vertically loaded into a furnace. Metal sheet steel shields can be applied to the part to protect the surfaces that are not to be nitrided. An electrical connection can be made with the part in a manner in which the part can function as a cathode. The furnace is sealed and the atmosphere pumped down to create a vacuum. The pump down pressure is preferably sufficiently low to clear or purge the atmosphere out of the heating vessel. In exemplary embodiments, the vacuum can be to a pressure of about 0.75 Torr. A leak check can optionally be performed to ensure desired conditions.

Once the desired vacuum pressure is achieved, the electrical power is turned on. The heating up time for the roll shell in the furnace will depend on the size of the roll shell, the furnace used, and on the power being applied. An exemplary furnace suitable for the nitriding process is a PlaTeg Nitriding Furnace manufactured by PlaTeg GmbH, Germany. In exemplary embodiments in which the roll shell is 1,600 lbs in weight or heavier, the heat in the furnace can be ramped up at a rate of about 2° C./minute until a first temperature of about 425° C.±10° C. is reached. The temperature is then held for about 20 min. A mixture of nitrogen and hydrogen is then slowly introduced. In exemplary embodiments, the initial mixture of nitrogen and hydrogen can be 80% hydrogen and 20% nitrogen. It should be understood, however, that the concentration of nitrogen and hydrogen will vary gradually during the nitridation process. In exemplary embodiments during nitridation additional nitrogen can be introduced until the gas mixtures becomes 50% hydrogen and 50% nitrogen. Either just before, during or just after the introduction of the hydrogen/nitrogen gas mixture, the temperature of the furnace can be slowly increased to a second temperature of about 455° C.±10° C. The pressure is also increased to about 2 to 5 Torr, preferably to 3.5 Torr. The temperature of 455° C. and pressure of 2 to 5 Torr are maintained for at least 10 hrs while in the nitrogen plasma state achieved by applying a power of 15 KW. In exemplary embodiments, after the 10 hrs, the furnace can be turned off and the roll shell allowed to cool down in the furnace until the temperature of the roll shell is at or below 150° C. The cooled down roll shell can then be exposed to air. In exemplary embodiments, exposing the roll shell to air prior to cooling down to 150° C. or less can lead to discoloring.

The duration of the ion nitriding process can depend on the size of the steel roll shell. In an exemplary embodiment involving a standard size roll shell of 1,600 lbs to about 5,000 lbs, the overall nitriding process, i.e. from heating up to complete cool down, can last about 24 hours. In alternative embodiments, the roll shell being between 5,001 lbs and 7,500 lbs, the overall nitriding process can last about 30 hours. In yet alternative embodiments, the roll shell being between 7,501 lbs and 12,000 lbs, the overall nitriding process can last about 40 hours.

The nitriding step may also be carried out in ways other than ion nitriding or plasma nitriding. For example, the nitriding step may be carried out by gas nitriding or salt bath nitriding. However, when compared to ion nitriding and gas nitriding, salt bath nitriding can lead to less uniform case depth and potentially rough surfaces that can lead to spalling of the surface. Also, in comparison to salt bath nitriding, ion nitriding and gas nitriding can take place at a lower temperature. This can result in less distortion and requires no post-machining or polishing. Like in ion nitriding, in exemplary embodiments, the part to be treated by gas nitriding or salt bath liquid nitriding is preferably cleaned prior to processing to remove any dirt and/or oil. Thus, in exemplary embodiments a cleaning step with a solvent, such as acetone followed by a wipe down or similar cleaning step is performed prior to the gas nitriding or salt bath liquid nitriding processes described below.

Gas nitriding can, for example, be carried out by placing the steel roll shell into a high temperature furnace containing a nitrogen containing gas. Gas nitriding can be carried out at the same or similar temperature of ion nitriding. In exemplary embodiments, a nitrogen containing gas can be ammonia gas ($NH_3$). The ammonia can be dissociated in the furnace to yield nitrogen and hydrogen gasses. The nitriding process can be characterized as a Flue Process. The free nitrogen can react to create a nitride compound along the inner diameter of the steel roll shell. For example, the nitrogen can react with Cr, V, and/or Fe contained in the steel of the steel roll shell. The microstructure can be controlled by the ratio of disassociated ammonia and non-disassociated ammonia. At the beginning of the process, for example, the recipe can include 30-40% dissociated ammonia while during the bulk of the nitriding stage the level of dissociated ammonia will have increased to about 60-80%. The duration of the gas nitriding process can be similar to ion nitriding described above.

Salt bath liquid nitriding can be carried out by immersing the roll shell into a molten salt bath, at about 538° C., containing cyanates, allowing nitrogen atoms to diffuse into the surface. In exemplary embodiments, the bath can be an Aerated Bath Nitriding process, which involves pumping air into a molten salt bath containing 30% to 40% sodium cyanide (NaCN) or 30% to 40% potassium cyanide (KCN) and other salts such as for example 40% potassium chloride (KCl), and 20% sodium carbonate ($NaCO_3$). The process is slow compared to ion nitriding and gas nitriding and results in a thinner nitrided steel case compared to ion nitriding.

In still alternative embodiments multiple nitriding steps may be carried out to achieve the desired nitriding of the roll shell inner diameter surface. In such embodiments, the multiple nitriding steps may be performed in sequence and may involve either the repetition of the same nitriding step or a sequence of different nitriding steps. In an exemplary embodiment, multiple ion nitriding steps can be performed. In alternative embodiments, the multiple nitriding steps may include any two or more of ion nitriding, gas nitriding and liquid nitriding steps in various orders.

It is important to recognize that the present invention is directed to hardening the inner diameter surface of the steel roll shell and not the outer diameter surface of the core. In exemplary embodiments, the process can create smooth mating surfaces (for example ion nitrided roll shell inner diameter surface—core outer diameter surface), which is an improvement over the current method of Cr plating the roll shell inner diameter surface. In exemplary embodiments, nitriding the inner surface of the roll shell forms a surface layer. The surface layer formed by the nitriding step can be uniform. For purposes of this specification, the term "uniform" as used to refer to a surface layer indicates that the compositional characteristics (including materials, density, and molecular dispersion) of the surface layer are similar throughout the layer. The term "uniform" does not require exact compositional characteristics throughout the surface layer. The surface layer formed by the nitriding step can be a very hard, homogeneous surface that is preferably crack free and molecularly bonded with the roll shell steel.

The alloy content of the steel core can be any currently used in the art. In exemplary embodiments, the core is preferably formed by weld overlaying a AISI 4130 (1% Cr, 0.25% Mo) core with 420 SS (10-12% Cr) (up to 50 to 56 HRc). Other steel core may also be used. For example AISI 4340 (0.8% Cr, 1.75% Ni, 0.25% Mo). The steel core can be machined to generate cylindrical water channels. The design and size of the water channels is not particularly limiting. In exemplary embodiments the steel core can include water channels that are 0.5 inch wide by 0.5 inch deep machined circumferentially about 1.0 inch apart on the steel core.

The roll shell is also not particularly limited for purposes of this invention. In exemplary embodiments, the roll shell is made of steel. In preferred embodiments, the steel class of roll shells includes alloy steels that contain near saturated quantities of C in solid solution. The steel may also include other nitride forming elements such as Cr, Si, Cb (Nb), V and Al. In exemplary embodiments the roll shell is made of HS-521 (3% Cr, 0.5% V, 0.1% Al). Alternative embodiments include a roll shell made of T-244 (2% Cr, 0.32% V, 0.01% Al). Another exemplary embodiment includes a roll shell made of HSC-621 (1% Cr, 0.3% V, 0.35% Cb).

In embodiments, the Cr plating is not required. Thus, the issues Cr plating presents can be avoided. For example, as discussed earlier, over time the Cr plating can break down and the generated debris interferes with the casting process by reducing the heat transfer. Also, the galvanic corrosion that occurs under the breakdown of the Cr layer can result in cracks that propagate into the steel roll shell and eventually can cause complete failure of the roll shell. None of these issues would be encountered without Cr plating.

Furthermore, the process of the Cr plating the steel roll shell inner diameter surface typically requires a very clean, etched inner diameter surface, which is necessary to obtain a tight mechanical bond. When nitriding the roll shell inner diameter surface instead of Cr plating this is a less critical issue. In exemplary embodiments, nitrogen ions are bombarded into the steel at the treated surface during ion nitriding. This process can actually clean and remove surface oxide and dirt from the roll shell inner diameter surface. The process can result in a uniform chemical bond nitrided surface layer or case that is inherently better than a Cr plate, with improved galling resistance and galvanic corrosion resistance.

In exemplary embodiments, roll shell inner diameter surfaces can undergo nitriding to form a hard Cr, V, Fe nitride surface layer. This can result in improved galling and abrasion resistance and eliminate the need for Cr plating. FIG. 2 shows exemplary embodiments of the ion nitride surface layer depth in a roll shell inner diameter surface that has undergone a nitriding process. The surface layer depth of the nitride was measured to be approximately 0.004 inch to 0.008 inch. This is up to twice the typical 0.004 inch thickness of a Cr plating.

Hardness of the treated roll shell inner diameter surface was also measured and showed to be at levels of up to 66 to 68 HRc, much higher than the typical roll shell values of 45 HRc or Cr coated roll shell values of 60 HRc. This effect can be very beneficial in providing abrasion resistance to the inner diameter surface roll shell surface during casting.

Galling resistance can be improved proportionately by increasing the hardness difference between the two abrading materials. In exemplary embodiments, the hardness difference is achieved by increasing the hardness of the roll shell inner diameter surface to be higher than the hardness of the outer diameter surface of the core.

In exemplary embodiments, comparative data was collected to show the enhanced hardness difference between the inner diameter surface of the roll shell and the outer diameter surface of the core achieved through by nitriding the inner diameter surface of the roll shell. For purposes of this data the steel core used was a 420SS (10-12% Cr) core. The roll shells used were made of HS-521 (3% Cr) steel. The hardness was measured by standard ASTM E-18 Rockwell Hardness procedures and Hardness Conversion Tables for Metals, ASTM E140. Three samples were measured. Each sample was a 1,244 lbs roll shells, with a 20.90" outer diameter, a 17.30" inner diameter, and 40.70" in length. One roll shell was left untreated. One roll shell was Cr plated by immersing in a chromic acid bath with a negative potential applied to the shell. In this process the Cr ions are attracted and mechanically bonded to the shell steel. This process occurs at near room temperature and there is no diffusion of the Cr into the steel surface of the roll shell. Typically, rate of Cr plating is 0.001 to 0.003 inch per hour and the ultimate desired thickness of the Cr plate is about 0.004 inch. Greater plate thickness result in spalling of the Cr layer from the steel. The third roll shell was treated using ion nitriding as described earlier, i.e. treatment in a furnace at 455° C. for about 10 hr applying 15 KW at a pressure of 3.5 Torr in an environment that during the nitriding process includes a 50/50 nitrogen and hydrogen mixture to obtain an approximately 0.008 inch thick nitrided steel case. As shown in Table 1 below, the nitriding of the roll shell inner diameter surface resulted in much larger differences in hardness when compared to either non-treated roll shells or Cr plated roll shells.

TABLE 1

| Roll Shell ID Surface Condition | Surface Hardness (Rc) | 420SS Core Hardness (Rc) | Hardness Difference (Rc) |
|---|---|---|---|
| Bare uncoated | 45 | 54 | −9 (the Shell will wear) |
| Chrome plated | 60 | 54 | +6 (The core will wear in slight preference to the shell) |
| Nitrided | 67 | 54 | +13 (The shell is immune in wear) |

Table 1 shows that the hardness difference between a 420 stainless steel core and a nitrided roll shell was achieved to be +13 HRc. This was a much improved difference from the +6 HRc that was obtained using Cr plating and much higher than the untreated roll shell which was a −9 HRc. This large hardness difference can minimize galling.

Corrosion Test Results:

Even when Cr plating is not used, there may still be some degree of galvanic corrosion pressure directing the corrosion at the roll shell crevices. In some instances the galvanic corrosion pressure is due to the Cr content differential between the core weld overlay and the steel roll shell. For example, a SS 420 core weld overlay may contain 10% to 12% Cr while a typical HS-521 steel roll shell may contain 3% Cr.

In exemplary embodiments, however, the galvanic corrosion can be greatly reduced if not eliminated by way of nitriding the roll shell inner diameter surface. In a comparative example, the corrosion parameters from cyclic potentiodynamic polarization tests were measured. The results indicated that the galvanic corrosion effect on the sample that was ion nitrided was nearly zero and corrosion of the roll shell was minimal. One explanation may be the absence of porosity and cracks in the nitrided layer can provide the roll shell with significant advantages over the chrome plate.

Table 2 shows the corrosion parameters from cyclic potentiodynamic polarization scans. These tests were conducted on all 3 metals; SS 420, HS-521 (untreated) and HS-521N (ion nitrided to approximately 0.009 in depth and hardness of 66 to 68 HRc). Each metal sample was immersed in a three-electrode EG&G standard electrochemical flat cell with a defined window area of 1 $cm^2$ with the sample as the working electrode, a platinum mesh as the counter or auxiliary electrode. All potentials were measured against a saturated calomel reference electrode (sce).

The solution used was a typical commercial hard water sample. Specifically, the solution had a conductivity of 207 MMHOS/CM. The pH of the cooling water was 7.1. The water included dissolved ionizable cations such as Ca, Mg, Na, K, Fe, Sr, Ba, Mn, Cu and Zn. In particular the water included, less than 0.1 mg/L (as CaCO3) of each of Sr, Ba, Mn, Cu and Zn, 35.0 mg/L of Ca ions, 41.9 mg/L of Na ions, 9.5 mg/L of Mg, 4.4 mg/L of K, and 0.18 mg/L of Fe. The water also included dissolved ionizable anions such as Cl, SO4, and bicarbonate as the predominant anions. Specifically, the water included 34.1 mg/L of Cl, 20 mg/L of SO4, 1.44 mg/L of silica, 1 mg/L of F, less than 1.8 mg/L of NO3, and 0.4 mg/L of NO2.

TABLE 2

Corrosion Parameters from Cyclic Potentiodynamic Polarization Tests

| Part/Steel | Ecorr (mVsce)-(1) | i corr (uA/cm2)-(2) | ICR (mpy)***(3) |
|---|---|---|---|
| SS 420 Weld Overlay (10-12% Cr) | −95.0 | 0.0674 | 0.0293 |
| HS-521 Roll shell (3% Cr) (Untreated I.D.) | −370.0 | 4.333 | 1.994 |
| HS-521N Roll shell (3% Cr) (Ion nitrided I.D.) | −74.7 | 0.0336 | 0.0155 |

(1)Corrosion potential in coolant water, above which part is attacked.
(2)Galvanic corrosion current.
(3)Calculated corrosion rate (Tafel method) in mils per year.

A potentiostat, connected to the electrodes, was used to measure the galvanic voltage and current and the samples were allowed to reach a corrosion potential (Ecorr) after a period of 1 hour. Lower Ecorr values indicate the metal is more anodic in standard water environments and subject to corrosive damage. Measurements of corrosion current (icore) also were made and calculations of corrosion rate (ICR) in mils per year (mpy) were done using the Tafel method. A low value of Ecorr and higher icorr indicates more galvanic corrosion occurring in the water solution. The values in Table 2 are the average of 3 metal samples each.

The SS 420 metal and HS-521 ion nitrided sample ("HS-521N") metal samples showed very low galvanic corrosion rates compared to the HS-521 untreated samples. The values were very similar and indicated very little potential for galvanic attack when SS 420 is coupled to HS-521N.

Increasing positive potential scans using the potentiostat, on each of the metal samples were made to force them to become more anodic and corroded. Values as high as 800 mVsce were generated and then allowed to drift back to steady state. These scans were done to determine the effect on the sample surfaces. Low magnification photos are shown in FIG. 3 for all three metals. As can be observed there was very little attack on the surfaces of HS-521N and SS 420 while significant corrosive attack showing general corrosion, pitting and crevice corrosion occurred in the HS-521 samples.

These results indicate that no significant galvanic corrosion is expected when HS-521N roll shells are in contact with SS 420 cores compared to the current HS-521—SS 420, roll shell—core combinations.

The elimination of Cr plating the roll shell inner diameter surface can reduce the tendency for galvanic corrosion damage to the roll shell as well as debris buildup in the water channels of the core. Another advantage of the elimination of the Cr plating may be that heat flow from the roll shell to the water cooled core would be increased because of elimination of the Cr plate barrier. The increased heat flow can result in an increase casting speed and productivity.

Thermal Conductivity Tests:

Thermal conductivity tests at room temperature confirmed that the ion nitride surface also had no deleterious effect on heat flow. Thermal conductivity tests were conducted using a method based on ASTM standard E1225 using 1 inch diameter by 1 inch height cylindrical samples. Heat transfer was measured from end to end by utilizing thermocouples at the each end. Uncoated HS-521 steel roll shell samples had a thermal conductivity of 31.7 W/m-k at 23° C. and the ion nitride HS-521N steel samples had 31.8 W/m-k at 23° C. While no thermal conductivity tests were made on the Cr plated steel shells, the advantage of the nitriding step in heat transfer is apparent because the steel nitrided case being molecularly bonded and having a higher hardness as described above does not suffer from the same debris problem presented by Cr plating. In the current practice of Cr plating the roll shell inner diameter surface can suffer from appreciable wear and/or breakage of the Cr plate during casting caused by the movement of the roll shell over the core. The subsequent debris generation is known to alter the heat flow over time, can directly affect the roll shell inner tolerances, which can eventually cause unacceptable Al strip thickness variations in the as-cast product. These as-cast thickness variations in the strip make it very difficult to cold roll to the required uniform Al foil thickness standards.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A strip casting apparatus comprising:

a cylindrical roll core; and a roll shell mounted around the cylindrical roll core and having a nitrided inner diameter surface, wherein the nitrided inner diameter surface is in contact with cooling water of the strip casting apparatus.

2. The apparatus of claim 1, the cylindrical roll core further comprises steel.

3. The apparatus of claim 2, the cylindrical roll core further comprises a stainless steel overlay containing 10-12% Cr.

4. The apparatus of claim 2, wherein the roll shell is a steel material.

5. The apparatus of claim 4, wherein the cylindrical roll core is a material selected from the group consisting of 1% Cr, 0.25% Mo steel; and 0.8% Cr, 0.25% Mo, 1.75% Ni steel.

6. The apparatus of claim 1, the roll shell further comprising steel.

7. The apparatus of claim 6, the roll shell steel further comprising an alloy that is one of:

3% Cr, 0.5% V, 0.1% Al;

2% Cr, 0.32% V, 0.01% Al; and

1% Cr, 0.3% V, 0.35% Cb.

8. The apparatus of claim 1, wherein the nitrided inner diameter surface of the roll shell has a hardness that is greater than a hardness of the cylindrical roll core.

9. The apparatus of claim 1, wherein the nitrided inner diameter surface of the roll shell has a hardness of 60-68 Rc.

10. The apparatus of claim 1, wherein the nitrided inner diameter surface of the roll shell comprises a uniform, molecular bonded surface layer.

11. The apparatus of claim 1, wherein the nitrided inner diameter surface of the roll shell comprises nitrogen atoms in solution and in compound form dispersed through a thickness of at least 0.004 inch.

12. The apparatus of claim 1, wherein the nitrided inner diameter surface of the roll shell further comprises a super saturated solid solution of iron and nitrogen.

13. The apparatus of claim 1, wherein the outer diameter surface of the roll shell is not nitrided.

14. The apparatus of claim 1, wherein the roll shell is shrink fitted onto the cylindrical roll core.

15. The apparatus of claim 14, wherein nitriding the inner diameter surface of the roll shell comprises at least one of ion nitriding, gas nitriding, and salt bath nitriding.

16. The apparatus of claim 14, wherein nitriding the inner diameter surface of the roll shell comprises gas nitriding.

17. The apparatus of claim 14, wherein nitriding the inner diameter surface of the roll shell is conducted until the inner diameter surface of the roll shell includes a super saturated solid solution of iron and nitrogen.

18. The apparatus of claim 14, wherein the roll shell is air cooled after nitriding.

19. The apparatus of claim 1, wherein the roll shell is nitrided discretely and not over an entirety of the inner diameter surface of the roll shell.

20. The apparatus of claim 1, wherein the nitrided inner diameter surface of the roll shell further comprises a near saturated solution of carbon.

21. The apparatus of claim 1 further comprising cooling channels to accommodate the cooling water.

22. The apparatus of claim 21, wherein the cooling channels are formed in an outer diameter surface of the cylindrical roll core.

* * * * *